United States Patent [19]

Roodbeen, Leonardus F. H.

[11] Patent Number: 4,711,549

[45] Date of Patent: Dec. 8, 1987

[54] CONTACT FIXING DEVICE WITH AN IMPROVED CLEANING MECHANISM

[75] Inventor: Roodbeen, Leonardus F. H., NV Kronenberg, Netherlands

[73] Assignee: Oce-Nederland B.V., Venlo, Netherlands

[21] Appl. No.: 872,218

[22] Filed: Jun. 9, 1986

[30] Foreign Application Priority Data

Jun. 14, 1985 [NL] Netherlands ..... 8501718

[51] Int. Cl.[4] ..... G03G 21/00

[52] U.S. Cl. ..... 355/3 FU; 15/256.51; 219/216; 355/15; 355/30; 432/60

[58] Field of Search ..... 355/3 R, 3 FU, 14 FU, 355/15, 30; 15/256.51, 256.52; 219/216; 432/60

[56] References Cited

U.S. PATENT DOCUMENTS 3,861,861 1/1975 Thettu ..... 15/256.52 X 4,390,268 6/1983 Furuichi et al. ..... 355/15

4,411,042 10/1983 Sakata et al. ..... 355/15 X 4,607,947 8/1986 Ensing et al. ..... 355/15

*Primary Examiner*—Fred L. Braun

*Attorney, Agent, or Firm*—Reed Smith Shaw & McClay

[57] ABSTRACT

A contact fixing device primarily used in electrophotographic copiers is provided with a driven and heated fixing surface which is made from a partially resilient material and a driven pressure surface which presses against the fixing surface forming a fixing zone through which copy material can be fed for fixing a toner image thereon. It also has a hollow perforated cleaning roller which while rotating in contact with the fixing surface takes up toner from the fixing surface. To prevent contamination of the device due to toner material flowing over the ends of the cleaning roller, the device is provided with a disc roller near each end of the cleaning roller which presses against the cleaning roller and is thereby rotationally driven.

2 Claims, 2 Drawing Figures

CONTACT FIXING DEVICE WITH AN IMPROVED CLEANING MECHANISM

BACKGROUND OF THE INVENTION

1. Field of the Invention

The present invention relates to a contact fixing device used primarily in electrophotographic copiers for fixing a toner image on a sheet material.

2. Description of the Prior Art

European Patent Application No. 0149860 which corresponds to U.S. Pat. No. 4,706,947 describes a contact fixing device for fixing a toner image on a sheet material. In this device, toner and other material which adheres to the fixing surface is taken up by the cleaning roller. Thus, a toner layer gradually forms on the surface of the cleaning roller and is subject to pressure as it passes through the nip between the cleaning roller and the fixing surface. As a result of the pressure in the nip, toner is forced through the perforations and into the interior of the cleaning roller.

The toner taken up by the cleaning roller is distributed uniformly over the roller surface by the pressure in the nip. The pressure distributes the toner material in all directions on the cleaning roller. Toner situated on the roller near its ends will move laterally over the roller surface under this pressure and will flow over those ends and contaminate the device as it becomes detached from the roller. It would be desirable to have a device which obviates this contamination.

U.S. Pat. No. 4,411,042 describes a toner cleaning apparatus used in a contact fixing device which could have the shape of a perforated roller. Residual toner particles on the fixing surface are scraped off by the edge portions of the perforations and fall into a receptacle in the interior of the cleaning apparatus. With this cleaning apparatus, there is nothing to prevent the toner material from moving laterally over the cleaning surface and eventually flowing over the ends of the cleaning device causing contamination as described above.

U.S. Pat. No. 3,649,992 discloses another cleaning apparatus used in a contact fixing device which does not employ a perforated cleaning roller. Instead, it uses a plurality of washer-shaped rollers upon which the toner particles cool and solidify forming a layer. When the layer of toner particles builds up on the rollers, the rollers are replaced. The end caps only hold the washer-shaped rollers in place and do not press against the fixing surface. If toner builds up quickly in this device, the rollers will need to be replaced very often causing inefficiency.

A still different cleaning system used in a contact fixing device is described in U.S. Pat. No. 4,165,173 which is equivalent to German Patent Application No. 2,744,555. This system utilizes a first scraper blade for removing residual toner particles from the surface of a photosensitive drum, a resilient unperforated transfer roller which picks up the removed toner particles but does not press against the photosensitive drum and a second scraper blade which removes toner particles from the transfer roller surface. One disadvantage with this system is that the scraper blades can damage the transfer roller. Additionally, not all of the residual toner is removed because the transfer roller does not press against the photosensitive drum.

SUMMARY OF THE INVENTION

Generally, the present invention relates to a contact fixing device comprising a fixing surface made from a somewhat resilient material, a means for driving the fixing surface, a means for heating the fixing surface, a pressure surface which presses against the fixing surface forming a fixing zone through which copy material can be fed for fixing a toner image thereon, a means for driving the pressure surface, a hollow perforated cleaning roller which while rotating in contact with the fixing surface takes up toner from the fixing surface and a disc roller, the circumference of which is covered with a somewhat resilient material, provided near each end of the cleaning roller such that it presses against the cleaning roller and is thereby rotationally driven.

The presence of the disc rollers forms two pressure zones on the surface of the cleaning roller, one near each end. When the toner layer present on the cleaning roller tends to spread out in the lateral direction towards the roller ends due to the pressure in the nip, it will be prevented from so doing by the pressure zone at each end. The toner material cannot pass the pressure zones which act as barriers. Also, the toner material will be pressed back by the movement of the disc roller covering which is pressed resiliently away from the contact point in the pressure zones. Thus, contamination of the roller ends is prevented because the toner material cannot escape from the area defined by the disc rollers.

Preferably, the disc roller covering is made from a material to which toner adheres poorly such as silicone rubber. Use of such a material prevents toner which accidentally reaches a disc roller from adhering to it.

Other features and advantages of the present invention will be apparent from the following detailed description and with reference to the accompanying drawings.

DESCRIPTION OF THE PREFERRED EMBODIMENTS

Figure 1:
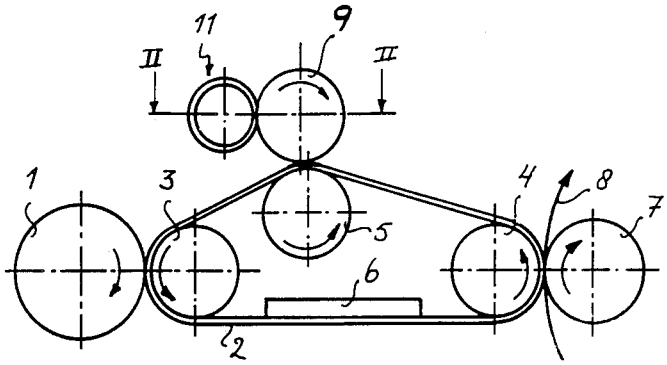
FIG. 1 is a diagrammatic cross-section of a contact fixing device according to the present invention.

FIG. 1 shows an image-bearing element 1 such as a rotating photo-conductive cylinder on which an image consisting of thermoplastic image powder or toner is formed by well known electrophotographic means which are not shown. A fixing belt 2 is trained about rollers 3, 4 and 5 and is driven such that image-bearing element 1 and belt 2 have identical superficial speeds. Rollers 3, 4 and/or 5 are driven by a drive means (not shown) such as a motor and connecting mechanism which are known to those skilled in the art of electrophotographic copiers.

Belt 2 is made from or covered with a heat-resistant and resilient material such as silicone rubber. During its advance, belt 2 is heated by a heating means 6 such as a flat heater element over which the belt slides. Belt 2 is pressed against image-bearing element 1 by means of roller 3. Belt 2 is also pressed against roller 7 by means of roller 4. Roller 7 rotates at the same superficial speed as belt 2.

A toner image formed on image-bearing element 1 is transferred onto belt 2 due to the pressure in the nip between image-bearing element 1 and belt 2 trained about roller 3. Since belt 2 is heated, the transferred toner image is also heated and becomes tacky. The transferred toner image is carried by belt 2 to roller 7.

When a sheet of paper 8 is passed between belt 2 and roller 7 at the correct time, the tacky toner image will be pressed between the fibers of sheet 8 due to the pressure in the nip between belt 2 and roller 7 and will adhere thereto. When sheet 8 is then separated from belt 2 and the toner material has cooled, the image is fixed on sheet 8.

Figure 2:
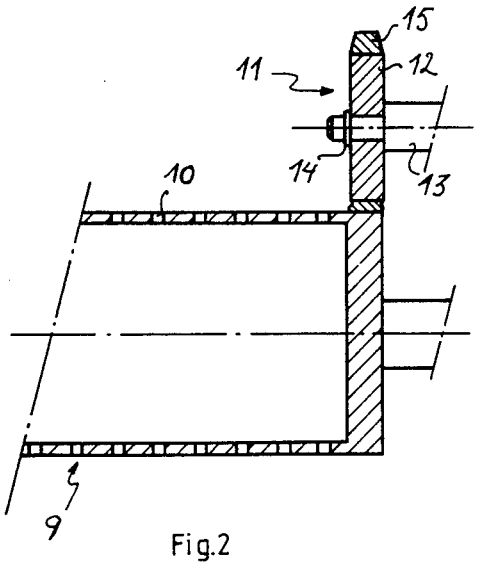
FIG. 2 is an enlarged diagrammatic longitudinal section of part of the cleaning mechanism used in the contact fixing device shown in FIG. 1.

Toner particles which have not been transferred onto sheet 8 after passing the nip between belt 2 and roller 7 are carried by belt 2 to the nip between belt 2 and a cleaning roller 9. Cleaning roller 9 is hollow and is made from a material such as steel or aluminum for which the tacky toner material has a great affinity. As shown in FIG. 2, cleaning roller 9 is also provided with a large number of small perforations 10 of a diameter of about 1–3 mm, which are distributed over the entire surface of cleaning roller 9 in a pattern such that, when belt 2 rotates, each part of the surface of belt 2 comes into contact with a part of the surface of cleaning roller 9 containing the perforations.

Good cooperation between belt 2 and cleaning roller 9 can be obtained if cleaning roller 9 presses on belt 2 by its own weight and is rotatingly driven by the friction between it and belt 2. Consequently, toner particles present on belt 2, together with any impurities retained thereon, such as dust and paper fibers, adhere to cleaning roller 9 and form a layer thereon. Pressure is exerted on this layer as it passes the nip between belt 2 and cleaning roller 9 causing the toner material to be pressed through the perforations and to be discharged into the interior of cleaning roller 9.

The toner material in the layer on cleaning roller 9 moves in every direction and is distributed uniformly over the surface by the pressure in the nip. To prevent toner particles or material from reaching the ends of cleaning roller 9, a disc roller 11 is provided near each end of cleaning roller 9. Disc roller 11 presses against and is driven by cleaning roller 9 as shown in FIG. 2. Disc roller 11 prevents toner material from passing the ends of cleaning roller 9 and becoming detached, thereby contaminating the device.

Preferably, disc roller 11 consists of a drilled disc 12 rotatably mounted and secured on the thinned end of a shaft 13 by means of a clamp ring 14. The circumference of disc 12 is covered with a layer of resilient material 15, such as a layer of elastomeric material of 5 mm thickness with a hardness of 50°–70° Shore A. Shaft 13 is positioned at a distance from cleaning roller 9 such that layer 15 is compressed considerably at the place where it contacts cleaning roller 9. During the compression, layer 15 is pressed resiliently away from the point of contact such that the elastomeric or rubber material moves across the surface of cleaning roller 9 at least to a considerable extent.

When toner material present on cleaning roller 9 moves towards the ends thereof due to the pressure in the nip between belt 2 and cleaning roller 9, the toner material will encounter a pressure zone in the nip between cleaning roller 9 and disc roller 11. In the pressure zone, the toner material is pressed back onto the surface of cleaning roller 9 by the movement of layer 15. Thus, toner material moving in the direction of one end of cleaning roller 9 due to the pressure in the nip between belt 2 and cleaning roller 9 is pushed back by the pressure in the nip between cleaning roller 9 and disc roller 11, thereby preventing contamination of the device.

To prevent toner material from adhering to the circumference of disc roller 11, layer 15 can be made of a material for which the toner material has little affinity, such as silicone rubber. While presently preferred embodiments of the invention have been described and shown in the drawings with particularity, the invention may be otherwise embodied within the scope of the appended claims.

What is claimed is:

1. A contact fixing device comprising a fixing surface made from a somewhat resilient material, a means for driving the fixing surface, a means for heating the fixing surface, a pressure surface which presses against the fixing surface forming a fixing zone through which copy material can be fed for fixing a toner image thereon, a means for driving the pressure surface, a hollow perforated cleaning roller which while rotating in contact with the fixing surface takes up toner from the fixing surface and a disc roller, the circumference of which is covered with a somewhat resilient material, provided near each end of the cleaning roller such that it presses against the cleaning roller to prevent toner from flowing over the ends thereof and is thereby rotationally driven.

2. A device as described in claim 1 wherein the disc roller is covered with a material to which toner adheres poorly.

* * * * *